US007219717B2

(12) United States Patent
Hanafusa

(10) Patent No.: US 7,219,717 B2
(45) Date of Patent: May 22, 2007

(54) EVAPORATOR AND REFRIGERATION CYCLE

(75) Inventor: Tatsuya Hanafusa, Oyama (JP)

(73) Assignee: Showa Denko K.K., Tokyo (JP)

( * ) Notice: Subject to any disclaimer, the term of this patent is extended or adjusted under 35 U.S.C. 154(b) by 235 days.

(21) Appl. No.: 10/505,768

(22) PCT Filed: Feb. 28, 2003

(86) PCT No.: PCT/JP03/02292

§ 371 (c)(1),
(2), (4) Date: Aug. 26, 2004

(87) PCT Pub. No.: WO03/073022

PCT Pub. Date: Sep. 4, 2003

(65) Prior Publication Data

US 2006/0118283 A1 Jun. 8, 2006

Related U.S. Application Data

(60) Provisional application No. 60/363,244, filed on Mar. 12, 2002, provisional application No. 60/363,369, filed on Mar. 12, 2002.

(30) Foreign Application Priority Data

Feb. 28, 2002 (JP) ..... 2002-053382
Feb. 28, 2002 (JP) ..... 2002-053393

(51) Int. Cl.
*F28D 1/03* (2006.01)

(52) U.S. Cl. ..... 165/153; 165/174; 165/176

(58) Field of Classification Search ..... 165/153, 165/174, 176, 178
See application file for complete search history.

(56) References Cited

U.S. PATENT DOCUMENTS 4,274,482 A * 6/1981 Sonoda ..... 165/153
5,465,783 A * 11/1995 O'Connor ..... 165/174
5,511,611 A * 4/1996 Nishishita ..... 165/153
5,645,126 A * 7/1997 Nishishita et al. ..... 165/153
5,826,648 A * 10/1998 Shimoya et al. ..... 165/153
6,070,428 A * 6/2000 Higashiyama et al. ..... 62/525
6,101,822 A * 8/2000 Groves ..... 62/174

(Continued)

FOREIGN PATENT DOCUMENTS

GB 2276937 A * 10/1994

(Continued)

*Primary Examiner*—Leonard R. Leo
(74) *Attorney, Agent, or Firm*—Oblon, Spivak, McClelland, Maier & Neustadt, P.C.

(57) ABSTRACT

An evaporator including an evaporator core having a refrigerant inlet and a refrigerant outlet in one side portion thereof, and a connecting member joined to the side portion of the core and having in its interior a refrigerant inlet channel and a refrigerant outlet channel. The connecting member includes first and second plates. The second plate has an inlet channel recessed portion and an outlet channel recessed portion provided, each in the bottom wall thereof, with an inlet pipe connecting opening and an outlet pipe connecting opening, respectively. The first plate has on the outer surface thereof a refrigerant flow smoothing projection projecting toward the inlet pipe connecting opening. Refrigerant flowing into the inlet channel flows along the projection surface, thereby changes its flow direction smoothly and is less likely to produce a turbulent flow. The evaporator is therefore adapted to prevent occurrence of noises due to refrigerant flow.

22 Claims, 8 Drawing Sheets

U.S. PATENT DOCUMENTS 6,129,144 A * 10/2000 Bousquet ..... 165/153
6,145,587 A * 11/2000 Hanafusa ..... 165/153
6,196,306 B1 * 3/2001 Aikawa et al. ..... 165/178
6,257,325 B1 * 7/2001 Watanabe et al. ..... 165/153
6,698,509 B2 * 3/2004 Rong ..... 165/153

FOREIGN PATENT DOCUMENTS

JP 04356690 A * 12/1992
JP 10-170101 6/1998
JP 11-094398 4/1999
JP 11094398 A * 4/1999
JP 2000-283603 10/2000
JP 2000283603 A * 10/2000

* cited by examiner (a)

(b)

EVAPORATOR AND REFRIGERATION CYCLE

CROSS REFERENCE TO RELATED APPLICATIONS

This application is an application filed under 35 U.S.C. §111(a) claiming the benefit pursuant to 35 U.S.C. §119(e)(1) of the filing date of Provisional Applications No. 60/363,244 and No. 60/363,369 both filed Mar. 12, 2002 pursuant to 35 U.S.C. §111(b).

TECHNICAL FIELD

The present invention relates to evaporators, for example, for use in motor vehicle air conditioners, and to motor vehicle air conditioners and like refrigeration cycles comprising the evaporator.

BACKGROUND ART

For example in refrigeration cycles such as motor vehicle air conditioners, noises made by the flow of refrigerant, such as a whistling noise and hissing noise, are produced mainly in condensers or expansion valves. However, such noises are likely to occur in evaporators depending on the conditions involved in the flow of the refrigerant. Especially in the case of motor vehicle air conditioners, noises released from the evaporator which is provided at a position relatively close to the vehicle compartment will be disagreeable to the passenger.

As means for solving such a problem of noises, already proposed are a refrigerant distributor disposed at a position upstream from the evaporator and having a sound absorbing material incorporated therein (see JP-A No. 10-185363) or a muffler disposed upstream from the evaporator (see JP-A No. 11-325655).

These means use the sound absorbing material or muffler in addition to the usual components of the refrigeration cycle and will therefore require a correspondingly increased cost or additional space for installation.

A first object of the present invention is to make it possible to prevent occurrence of noises in an evaporator due to the flow of refrigerant in motor vehicle air conditioners or like refrigeration cycles, by contriving the construction of the evaporator itself without using additional means such as a muffler.

Further already known, for example, for use in motor vehicle air conditioners are evaporators which have a multi-pass providing inner pipe inserted in an evaporator core through a refrigerant inlet thereof to provide at least two passes and thereby achieve an improved air cooling effect (see U.S. Pat. No. 5,431,217).

Such evaporators include those which comprise an evaporator core having a refrigerant inlet and a refrigerant outlet in one side portion thereof, and a connecting member joined to the side portion of the evaporator core and having in its interior a refrigerant inlet channel for holding the refrigerant inlet in communication with a refrigerant inlet pipe and a refrigerant outlet channel for holding the refrigerant outlet in communication with a refrigerant outlet pipe (see the publication of JP-A No. 2000-283603).

When the refrigerant for use in the above evaporator flows into the inner pipe from the refrigerant inlet channel via the refrigerant inlet, the flow of refrigerant changes its course approximately through a right angle. If the diameter of the inlet channel is excessively larger than the inside diameter of the inner pipe, the flow of refrigerant involves an increased pressure loss, possibly failing to exhibit the contemplated air cooling performance.

Incidentally, the inner pipe is inserted in the core of the above evaporator through the refrigerant inlet, whereas there are some evaporators wherein the inner pipe is inserted in the evaporator core through the refrigerant outlet. In this case, the refrigerant flowing out of the inner pipe into the refrigerant outlet channel will change its course approximately through a right angle. If the diameter of the outlet channel is excessively greater than the inside diameter of the inner pipe, an increased refrigerant pressure loss will also result to entail impaired cooling performance.

A second object of the present invention is to provide a refrigeration cycle, such as a motor vehicle air conditioner, wherein a multi-pass providing inner pipe is inserted in the evaporator core of the evaporator and which is adapted to reduce the pressure loss to be involved in the portion where the refrigerant is introduced into the inner pipe or the portion where the refrigerant is discharged from the inner pipe so as to ensure outstanding air cooling performance.

DISCLOSURE OF THE INVENTION

The present invention provides a first evaporator which comprises an evaporator core having a refrigerant inlet and a refrigerant outlet in one side portion thereof, and a connecting member joined to said one side portion of the evaporator core and having in its interior a refrigerant inlet channel for holding the refrigerant inlet in communication with a refrigerant inlet pipe and a refrigerant outlet channel for holding the refrigerant outlet in communication with a refrigerant outlet pipe. The connecting member comprises a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed each at one end thereof to the inlet communication hole and the outlet communication hole respectively. The other end of the inlet channel recessed portion has a bottom wall provided with an inlet pipe connecting opening, the other end of the outlet channel recessed portion having a bottom wall provided with an outlet pipe connecting opening, the refrigerant inlet pipe and the refrigerant outlet pipe being connectable to the respective connecting openings by a pipe joint member joined to an outer surface of the second plate. The first plate is provided on the outer surface thereof with a refrigerant flow smoothing projection projecting toward the inlet pipe connecting opening of the second plate.

A refrigerant subjected to a pressure reduction by an expansion valve and in a gas-liquid two-phase state flows into the refrigerant inlet channel of the connecting member of the evaporator through a refrigerant inlet pipe and the pipe joint member and further through the inlet pipe connecting opening. The refrigerant flowing in impinges on the outer surface of the first plate opposed to the inlet pipe connecting opening, whereby the refrigerant changes its course approximately though a right angle to flow down the inlet channel. The refrigerant then flows into the evaporator core through the refrigerant inlet. If the outer surface of the first plate opposed to the inlet pipe connecting opening is flat, the change of direction of the refrigerant flow involves increased resistance and the flow becomes turbulent, consequently permitting the operation of the air conditioner or like refrigeration cycle to produce noises. When the first plate is provided on the outer surface thereof with the refrigerant flow smoothing projection projecting toward the inlet pipe connecting opening of the second plate, the refrigerant flowing into the inlet channel flows along the surface of the projection, whereby the flow of refrigerant has its course changed smoothly and is made less likely to become turbulent. The first evaporator of the invention is therefore operable without producing noises due to the inflow of the refrigerant.

With the first evaporator of the invention, the center of the refrigerant flow smoothing projection is preferably in coincidence with the center of the inlet pipe connecting opening.

If the projection is so positioned as stated above, the refrigerant inlet portion exhibits an improved effect to smooth the flow of refrigerant due to the presence of the projection, reliably preventing the occurrence of noises.

With the first evaporator of the invention, the first plate may be provided on the outer surface thereof with a refrigerant flow smoothing projection projecting toward the outlet pipe connecting opening, in place of or in addition to the projection provided at the refrigerant inlet portion.

The noise produced by the flow of refrigerant in the evaporator is generally liable to occur at the refrigerant inlet portion as stated above. However, the flow of refrigerant will become turbulent at the refrigerant outlet portion to produce noise, depending on the conditions involved in the refrigerant flow. When the refrigerant flow smoothing projection projecting toward the outlet pipe connecting opening is formed on the outer surface of the first plate as described above, the refrigerant flowing down the outlet channel flows along the surface of this projection, has its course thereby smoothly changed and becomes less prone to turbulence. This eliminates the noise to be produced by the outflow of the refrigerant.

With the evaporator described, the center of the refrigerant flow smoothing projection is also preferably in coincidence with the center of the outlet pipe connecting opening.

If the projection is so positioned as stated above, the refrigerant outlet portion exhibits an improved effect to smooth the flow of refrigerant due to the presence of the projection, reliably preventing the occurrence of noises.

With the first evaporator of the invention, the refrigerant flow smoothing projection is not specifically limited in shape insofar as the refrigerant flowing into the inlet channel or flowing out of the outlet channel can be prevented from flowing unevenly or turbulently. The projection is, for example, substantially conical, frustoconical or semispherical.

If the projection is substantially conical, frustoconical or semispherical, the refrigerant can change its course smoothly by flowing along the surface of the projection and is less likely to become turbulent.

With the first evaporator of the invention, the evaporator core is not particularly limited in construction insofar as the refrigerant inlet and the refrigerant outlet can be provided in one side portion thereof. Stated more specifically, the evaporator core comprises upper and lower two horizontal headers, and a plurality of vertical heat exchange tubes arranged laterally at a spacing and each having opposite ends communicating with the upper and lower headers respectively, the refrigerant inlet being provided at one end of one of the upper and lower headers, the refrigerant outlet being provided at one end of the other header.

The evaporator core described above may be of the layered type which comprises a multiplicity of core plates each having an upper and a lower header recessed portion, and a tube recessed portion having opposite ends integral with the respective header recessed portions and shallower than the header recessed portions, and which is fabricated by joining each pair of these core plates to each other with each pair of corresponding recessed portions opposed to each other.

The present invention further provides a first refrigeration cycle which comprises the first evaporator described.

The noise to be produced by the flow of refrigerant in the evaporator of this refrigeration cycle is prevented by the refrigerant flow smoothing projection provided in the evaporator itself. This realizes a silent operation without necessitating an additional cost or additional installation space since there is no need to incorporate a special device at a position upstream from the evaporator as practiced conventionally. The invention is advantageously applicable especially to motor vehicle air conditioners.

The present invention provides a second evaporator which comprises an evaporator core having a refrigerant inlet and a refrigerant outlet in one side portion thereof, and a connecting member joined to said one side portion of the evaporator core and having in its interior a refrigerant inlet channel for holding the refrigerant inlet in communication with a refrigerant inlet pipe and a refrigerant outlet channel for holding the refrigerant outlet in communication with a refrigerant outlet pipe. The connecting member comprises a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed each at one end thereof to the inlet communication hole and the outlet communication hole respectively. A multi-pass providing inner pipe is inserted in the evaporator core through the inlet communication hole and the refrigerant inlet and provided at a base end thereof with a flange joined to an inner periphery of the first plate defining the inlet communication hole. The other end of the inlet channel recessed portion has a bottom wall provided with an inlet pipe connecting opening, the other end of the outlet channel recessed portion having a bottom wall provided with an outlet pipe connecting opening, the refrigerant inlet pipe and the refrigerant outlet pipe being connectable to the respective connecting openings by a pipe joint member joined to an outer surface of the second plate. The refrigerant inlet channel is divided into at least two parallel inlet branch channels in the vicinity of the inlet pipe connecting opening, the inlet branch channels being combined together in the vicinity of the inlet communication hole.

A refrigerant subjected to a pressure reduction by an expansion valve and in a gas-liquid two-phase state flows into the refrigerant inlet channel of the connecting member of the evaporator through a refrigerant inlet pipe and the pipe joint member and further through the inlet pipe connecting opening. The refrigerant flowing in dividedly flows through at least two inlet branch channels in the same direction, the divided refrigerant portions combine together again in the vicinity of the inlet communication hole, and the confluent refrigerant thereafter flows into the inner pipe. The pressure loss of the refrigerant flowing into the inner pipe is smaller than when the refrigerant inlet channel is not branched, permitting the refrigerant to flow into the inner pipe smoothly. The second evaporator described therefore enables the refrigerant to flow into the evaporator core efficiently, consequently exhibiting improved air cooling performance.

The second evaporator according to the invention also has the following advantage. When the refrigerant inlet channel is divided into at least two branch channels, the recessed portions to be formed in the second plate for providing these branch channels can be made smaller in width, while the flat portion to be joined to the first plate is given an increased area. Accordingly, a sufficient pressure resistant strength is available against the flow of refrigerant even if a material of reduced thickness is used for the second plate, hence a corresponding cost reduction.

With the second evaporator of the invention, it is desired that the refrigerant outlet channel be also divided into at least two parallel outlet branch channels in the vicinity of the outlet communication hole, the outlet branch channels being combined together in the vicinity of the outlet pipe connecting opening.

If the refrigerant outlet channel is also divided into at least two branch channels, the recessed portions to be formed in the second plate for providing these branch channels can be made smaller in width, while the flat portion to be joined to the first plate is given an increased area. The second plate can then be further smaller in thickness.

In the second evaporator according to the invention, the first plate is provided in the outer surface thereof with an inlet recessed portion and an outlet recessed portion at portions thereof corresponding to the refrigerant inlet and the refrigerant outlet respectively, and the inlet communication hole is formed in a bottom wall of the inlet recessed portion. These two recessed portions are provided to form a clearance for the air to be cooled to pass therethrough between the evaporator core and the connecting member. In this case, it is desired that a part of the flange of the inner pipe preferably be opposed to a flat portion of the second plate, and that the remaining part of the flange be opposed to a bottom wall of one end of the inlet channel recessed portion of the second plate.

The flange of the inner pipe is joined to an inner peripheral portion of the first plate defining the inlet communication hole. Especially when the evaporator is used as such in a motor vehicle air conditioner, the inner pipe flange could inevitably slip off the hole-defining peripheral portion. In the event of such a situation occurring, the inner pipe slipping off the first plate will shift outward, permitting the flange in its entirety to come into contact with the bottom wall of one end of the inlet channel recessed portion of the second plate. This impedes the flow of refrigerant into the inner pipe or permits the refrigerant to flow into the pipe intermittently, impairing the function of the evaporator and rendering the motor vehicle air conditioner or like refrigeration cycle itself no longer serviceable as such. Accordingly, a part of the flange is positioned as opposed to the flat portion of the second plate as described above. Even if the inner pipe then inevitably slips off the first plate and shifts outward, with the flange partly brought into contact with the flat portion of the second plate, a clearance sufficient for the refrigerant to flow into the inner pipe therethrough will be created between the remaining part of the flange and the bottom wall of one end of the inlet channel recessed portion of the second plate. Consequently, the function of the evaporator will not be substantially impaired even in the event of the above situation occurring, and the motor vehicle air conditioner or like refrigeration cycle can be used continuously.

In the above-mentioned case, the flat portion of the second plate opposed to said part of the flange of the inner pipe is, for example, one end of a striplike flat portion provided at a position intermediate the width of the inlet channel recessed portion for dividing the refrigerant inlet channel into at least two branch channels. If the flat portion around the inlet channel recessed portion of the second plate has a sufficient width, the flange of the inner pipe may partly be opposed to this flat portion.

The present invention further provides a third evaporator which comprises an evaporator core having a refrigerant inlet and a refrigerant outlet in one side portion thereof, and a connecting member joined to said one side portion of the evaporator core and having in its interior a refrigerant inlet channel for holding the refrigerant inlet in communication with a refrigerant inlet pipe and a refrigerant outlet channel for holding the refrigerant outlet in communication with a refrigerant outlet pipe. The connecting member comprises a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed each at one end thereof to the inlet communication hole and the outlet communication hole respectively. A multi-pass providing inner pipe is inserted in the evaporator core through the outlet communication hole and the refrigerant outlet and provided at a base end thereof with a flange joined to an inner periphery of the first plate defining the outlet communication hole. The other end of the inlet channel recessed portion has a bottom wall provided with an inlet pipe connecting opening, the other end of the outlet channel recessed portion having a bottom wall provided with an outlet pipe connecting opening, the refrigerant inlet pipe and the refrigerant outlet pipe being connectable to the respective connecting openings by a pipe joint member joined to an outer surface of the second plate. The refrigerant outlet channel is divided into at least two parallel outlet branch channels in the vicinity of the outlet communication hole, the outlet branch channels being combined together in the vicinity of the outlet pipe connecting opening.

The refrigerant flowing through the evaporator core then flows through the inner pipe and further flows out of the refrigerant outlet into the refrigerant outlet channel of the connecting member. The refrigerant subsequently dividedly flows through the two or more outlet branch channels in the same direction, the divided refrigerant portions combine together again in the vicinity of the outlet pipe connecting opening, and the confluent flow is thereafter discharged from this opening into the refrigerant outlet pipe via the pipe joint member. The pressure loss of the refrigerant flowing out of the inner pipe is smaller than when the refrigerant outlet channel is not branched, and the refrigerant smoothly flows out of the inner pipe. Thus, the third evaporator enables the refrigerant to flow out of the evaporator core efficiently, consequently exhibiting improved air cooling performance.

In the case of the third evaporator of the invention, the refrigerant outlet channel is divided into at least two branch channels, so that even if the second plate is made from a material of reduced thickness, a sufficient pressure resistant strength is available against the flow of refrigerant to realize a cost reduction.

In the third evaporator of the invention, the refrigerant inlet channel is also preferably divided into at least two parallel inlet branch channels in the vicinity of the inlet pipe connecting opening, the inlet branch channels being combined together in the vicinity of the inlet communication hole.

If the refrigerant inlet channel is divided into at least two branch channels, the second plate can be made further smaller in thickness.

In the case where the first plate is provided in the outer surface thereof with an inlet recessed portion and an outlet recessed portion at portions thereof corresponding to the refrigerant inlet and the refrigerant outlet, respectively, in the third evaporator of the invention, with the outlet communication hole formed in a bottom wall of the outlet recessed portion, it is desired that a part of the flange of the inner pipe be opposed to a flat portion of the second plate, and that the remaining part of the flange be opposed to a bottom wall of one end of the outlet channel recessed portion of the second plate.

If the flange is partly opposed to the flat portion of the second plate, this arrangement has the following advantage. Even if the inner pipe inevitably slips off the first plate and shifts outward, with the flange partly brought into contact with the flat portion of the second plate, a clearance sufficient for the refrigerant to flow into the inner pipe therethrough will be created between the remaining part of the flange and the bottom wall of one end of the inlet channel recessed portion of the second plate. Consequently, the function of the evaporator will not be substantially impaired even in the event of the above situation occurring, and the motor vehicle air conditioner or like refrigeration cycle can be used continuously.

In the above case, the flat portion of the second plate opposed to said part of the flange of the inner pipe is, for example, one end of a striplike flat portion provided at a position intermediate the width of the outlet channel recessed portion for dividing the refrigerant outlet channel into at least two branch channels. If the flat portion around the outlet channel recessed portion of the second plate has a sufficient width, the flange of the inner pipe may partly be opposed to this flat portion.

In the second or third evaporator according to the invention, the first plate is preferably provided on the outer surface thereof with a refrigerant flow smoothing projection projecting toward at least one of the inlet pipe connecting opening and the outlet pipe connecting opening of the second plate.

The projection then affords the same advantage as the first evaporator. The flow smoothing projection projecting toward the inlet pipe connecting opening serves to more smoothly divide the refrigerant into the portions to be passed through the branch channels. The flow smoothing projection projecting toward the outlet pipe connecting opening serves to more smoothly combine the divided refrigerant portions from the outlet branch channels.

With the second or third evaporator of the invention, the evaporator core is not particularly limited in construction insofar as the refrigerant inlet and the refrigerant outlet can be provided in one side portion thereof. Stated more specifically, the evaporator core comprises upper and lower two horizontal headers, and a plurality of vertical heat exchange tubes arranged laterally at a spacing and each having opposite ends communicating with the upper and lower headers respectively, the refrigerant inlet being provided at one end of one of the upper and lower headers, the refrigerant outlet being provided at one end of the other header.

The evaporator core described above may be of the layered type which comprises a multiplicity of core plates each having an upper and a lower header recessed portion, and a tube recessed portion having opposite ends integral with the respective header recessed portions and shallower than the header recessed portions, and which is fabricated by joining each pair of these core plates to each other with each pair of corresponding recessed portions opposed to each other.

The present invention further provides a second refrigeration cycle which comprises the second or third evaporator described.

The refrigeration cycle attains outstanding air cooling performance since a reduction is achieved in the pressure loss to be involved in introducing the refrigerant into the multi-pass providing inner pipe installed within the evaporator or in discharging the refrigerant from the inner pipe.

BEST MODE OF CARRYING OUT THE INVENTION

Next, the preferred embodiment of the invention will be described with reference to FIGS. 1 to 7. In the following description, the upper, lower, left-hand and right-hand sides of FIG. 1 will be referred to as "upper," "lower," "left" and "right," respectively, and the upper side of FIG. 2 will be referred to as "front," and the lower side of FIG. 2 as "rear."

Figure 1:
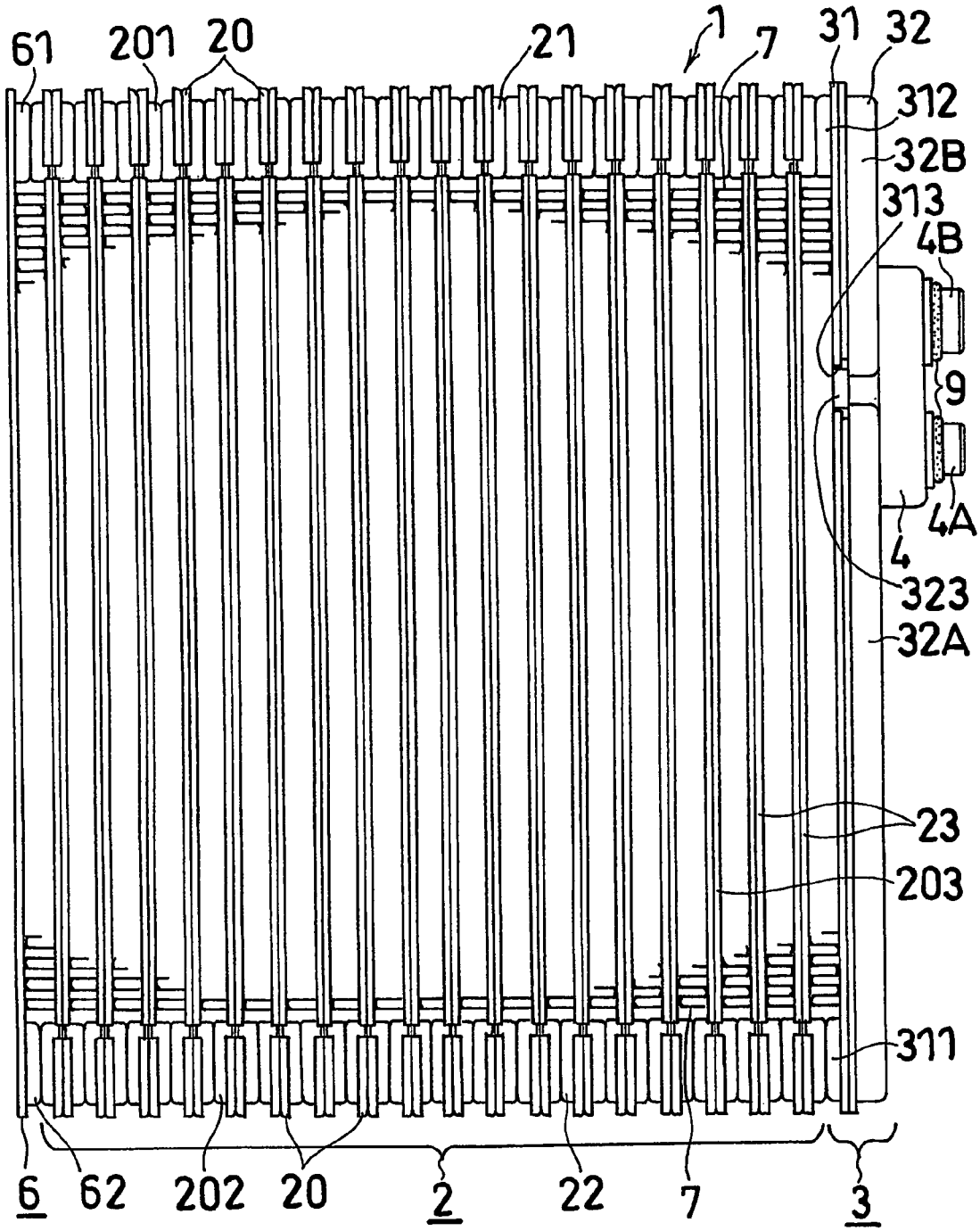
FIG. 1 is a front view of an embodiment of the invention, i.e., an evaporator.
Figure 2:
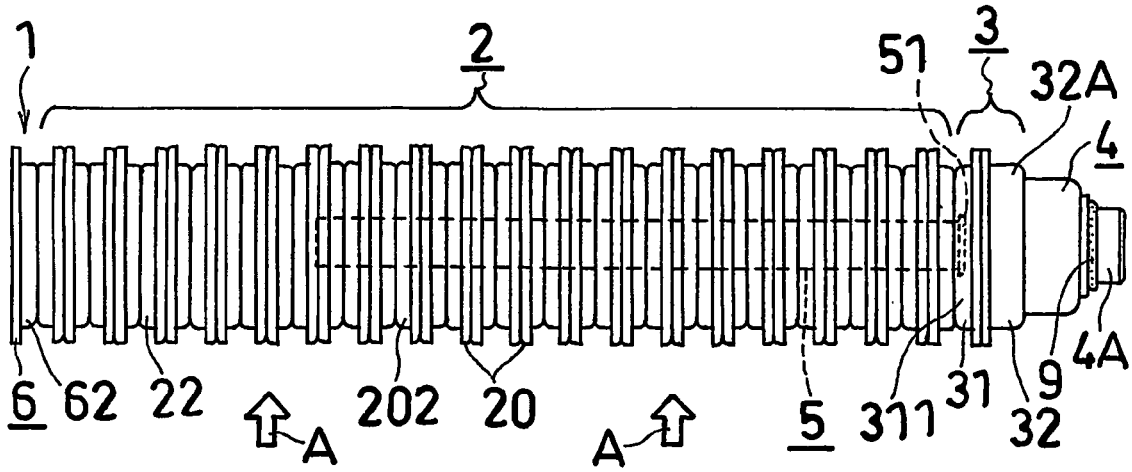
FIG. 2 is a bottom view of the evaporator.

The embodiment is a layered evaporator embodying the present invention for use in motor vehicle air conditioners. With reference to FIGS. 1 and 2, the evaporator 1 of the invention comprises an evaporator core 2, and a connecting member 3 joined to the right side of the core 2. A pipe joint member 4 is joined to a right side portion of the connecting member 3. The evaporator 1 of this embodiment is made of aluminum (including an aluminum alloy), and brazing is usually resorted to for joining the components of the evaporator to be described below.

The evaporator core 2 comprises upper and lower two horizontal headers 21, 22, and a plurality of vertical heat exchange tubes 23 arranged laterally at a spacing and each having opposite ends communicating with the upper and lower headers 21, 22, respectively. A refrigerant inlet 2A is provided at the right end of the lower header 22, and a refrigerant outlet 2B at the right end of the upper header 21 (see FIG. 7).

The evaporator core 2 comprises a multiplicity of core plates 20 each having upper and lower header recessed portions 201, 202, and a tube recessed portion 203 integral with the recessed portions 201, 202 at its opposite ends and shallower than these recessed portions 201, 202, and is fabricated by joining each pair of these core plates 20 to each other with each pair of corresponding recessed portions 201, 202 or 203 opposed to each other. A multi-pass providing inner pipe 5 is inserted in the lower header 22 through the refrigerant inlet 2A thereof as seen in FIG. 2.

With reference to FIGS. 1 and 2, a side plate 6 is provided at the left end of the evaporator core 2. The side plate 6 has at its upper and lower ends recessed portions 61, 62 of the same shape and size as the header recesses 201, 202. The bottom walls of these recessed portions 61, 62 are joined to the respective bottom walls of the upper and lower header recessed portions 201, 202 of the core plate 20 positioned at the left end.

As shown in FIG. 1, an outer fin 7 is fixedly provided in each of a clearance between each pair of adjacent heat exchange tubes 23, a clearance between the heat exchanger tube 23 at the left end and the side plate 6, and a clearance between the heat exchange tube 23 at the right end and the connecting member 3. The outer fin 7 is, for example, in the form of a corrugated fin as shown in FIG. 1. The air A to be cooled is passed through the clearances from the rear forward as shown in FIG. 2.

Figure 3:
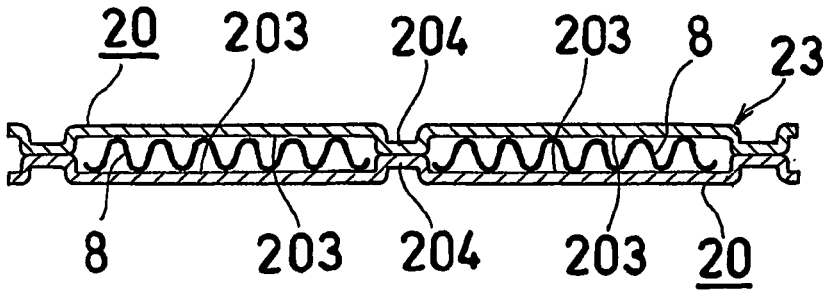
FIG. 3 is a view in horizontal section of a heat exchange tube in an evaporator core of the evaporator.

FIG. 3 shows the heat exchange tube 23 of the evaporator core 2. The tube recessed portion 203 of the core plate 20 is divided into front and rear two parts by a partition ridge 204 formed at the midportion of the width of the portion 203. Accordingly, the interior of the heat exchange tube 23 is also partitioned into front and rear two parts. The refrigerant flows through the front and rear parts of interior of the tube 23 in the same direction in parallel, and the two refrigerant portions will join at the upper or lower header 21 or 22. An inner fin 8 is enclosed in each of the front and rear parts of the tube 23. The inner fin 8 comprises, for example, a corrugated fin as seen in FIG. 3. Of course, the heat exchange tube is not always divided into front and rear parts as seen in FIG. 3.

Figure 4:
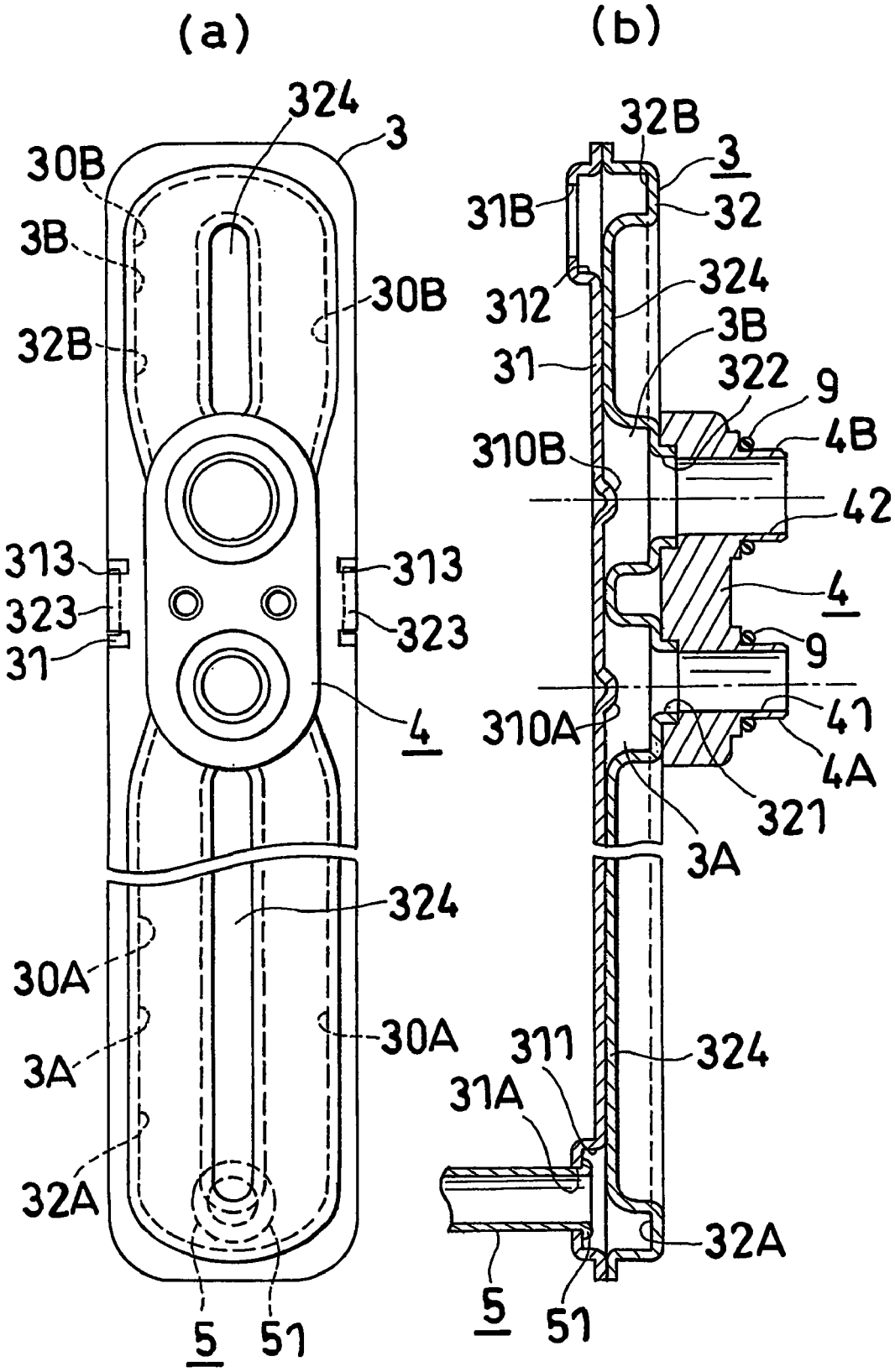
FIG. 4 shows a connecting member, pipe joint member and multi-pass inner pipe, (a) being a side elevation, (b) being a view in vertical section.
Figure 5:
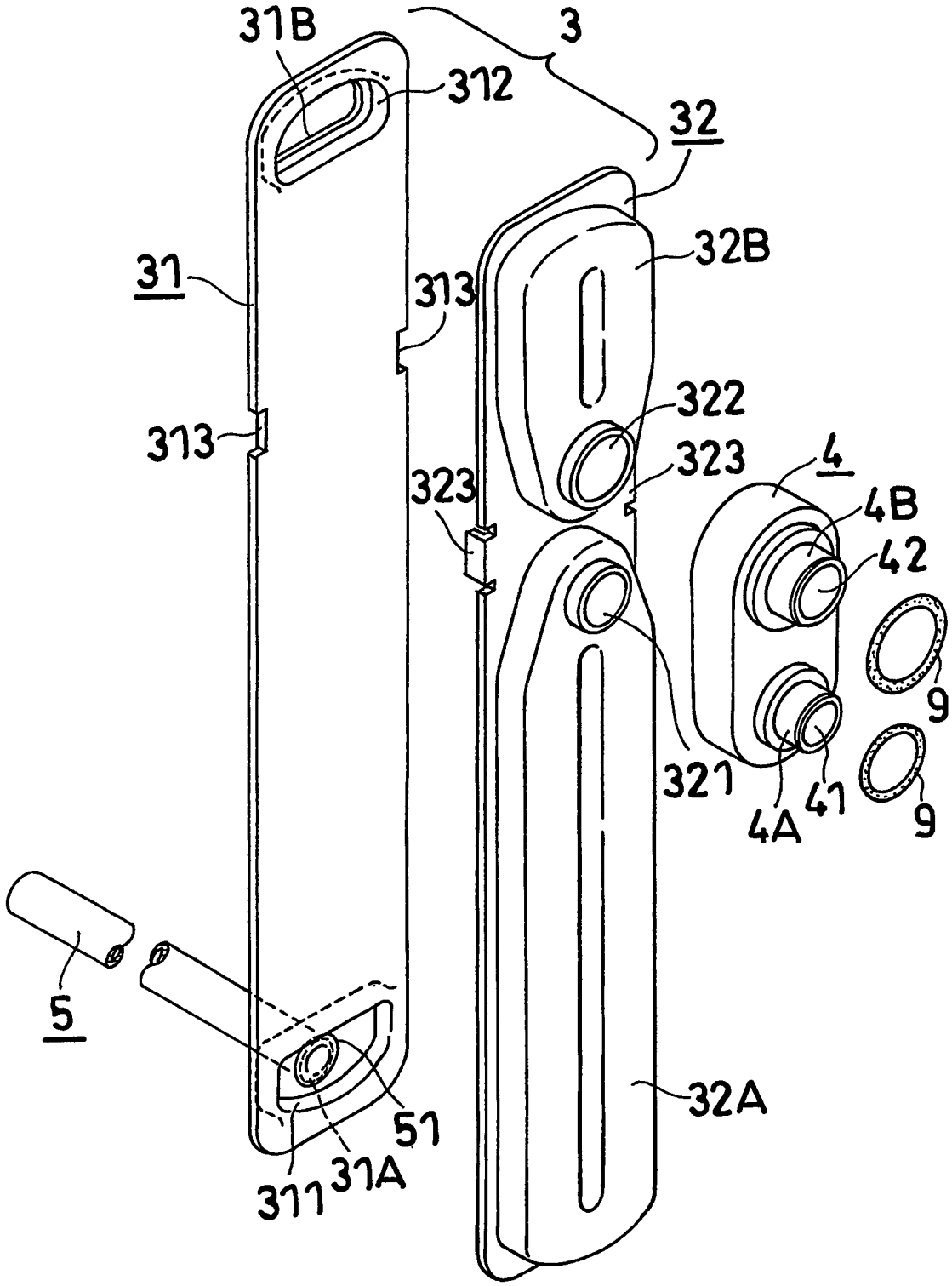
FIG. 5 is a perspective view showing the connecting member, pipe joint member and multi-pass inner pipe as disassembled.

FIGS. 4 and 5 show the connecting member 3 along with the pipe joint member 4 and the inner pipe 5. The connecting member 3 has in its interior a refrigerant inlet channel 3A for holding the refrigerant inlet 2A in communication with a refrigerant inlet pipe (not shown) and a refrigerant outlet channel 3B for holding the refrigerant outlet 2B in communication with a refrigerant outlet pipe (not shown). The connecting member 3 comprises a first plate 31 and a second plate 32.

The first plate 31 has an inlet communication hole 31A in a lower end portion thereof, and an outlet communication hole 31B in an upper end portion thereof. The plate 31 is joined to the right side of the evaporator core 2 so that these holes 31A, 31B communicate with the refrigerant inlet 2A and outlet 2B, respectively. The portion of the first plate 31 corresponding to the inlet 2A, i.e., the lower end portion, is provided with an inlet recessed portion 311. The portion of the first plate 31 corresponding to the outlet 2B, i.e., the upper end portion, is provided with an outlet recessed portion 312. These recessed portions 311, 312 are the same as the upper and lower header recessed portions 201, 202 of the core plate 20 in shape and size. The bottom walls of these recessed portions 311, 312 are joined to the bottom walls of upper and lower header recessed portions 201, 202 of the core plate 20 positioned at the right end. The inlet communication hole 31A is formed in the center of bottom wall of the inlet recessed portion 311, is circular and has a diameter approximately equal to the outside diameter of the inner pipe 5. The outlet communication hole 31B is formed in the bottom wall of the outlet recessed portion 312, is substantially similar to the bottom wall in shape and is elongated forward or rearward. A vertically elongated cutout 313 is formed in each of the front and rear edges of the first plate 31 at an intermediate portion of the height thereof.

The second plate 32 has a channel recessed portion 32A at a lower portion thereof for forming the refrigerant inlet channel and a channel recessed portion 32B at an upper portion thereof for forming the refrigerant outlet channel. The second plate 32 is joined to the outer surface of the first plate 31 so that the lower end of the channel recessed portion 32A is opposed to the inlet communication hole 31A, with the upper end of the channel recessed portion 32B opposed to the outlet communication hole 31B. The upper end of the inlet channel recessed portion 32A has a bottom wall provided with an opening 321 for connecting the refrigerant inlet pipe. The lower end of the outlet channel recessed portion 32B has a bottom wall provided with an opening 322 for connecting the refrigerant outlet pipe. These connecting openings 321, 322 are circular. The peripheral edges of these openings 321, 322 are projected outward. The front and rear edges of the second plate 32 each have an inwardly bent portion 323 at an intermediate portion of the height thereof. With the first and second plates 31, 32 fitted to each other, the bent portion 323 fits in the cutout 313 (see FIG. 1).

The first plate 31 is provided on the outer surface thereof with upper and lower two projections 310A, 310B projecting toward the inlet pipe connecting opening 321 and the outlet pipe connecting opening 322, respectively, for smoothing the flow of refrigerant.

The center of the lower projection 310A is in coincidence with the center of the inlet pipe connecting opening 321. The center of the upper projection 310B coincides with the center of the outlet pipe connecting opening 322.

Figure 8:
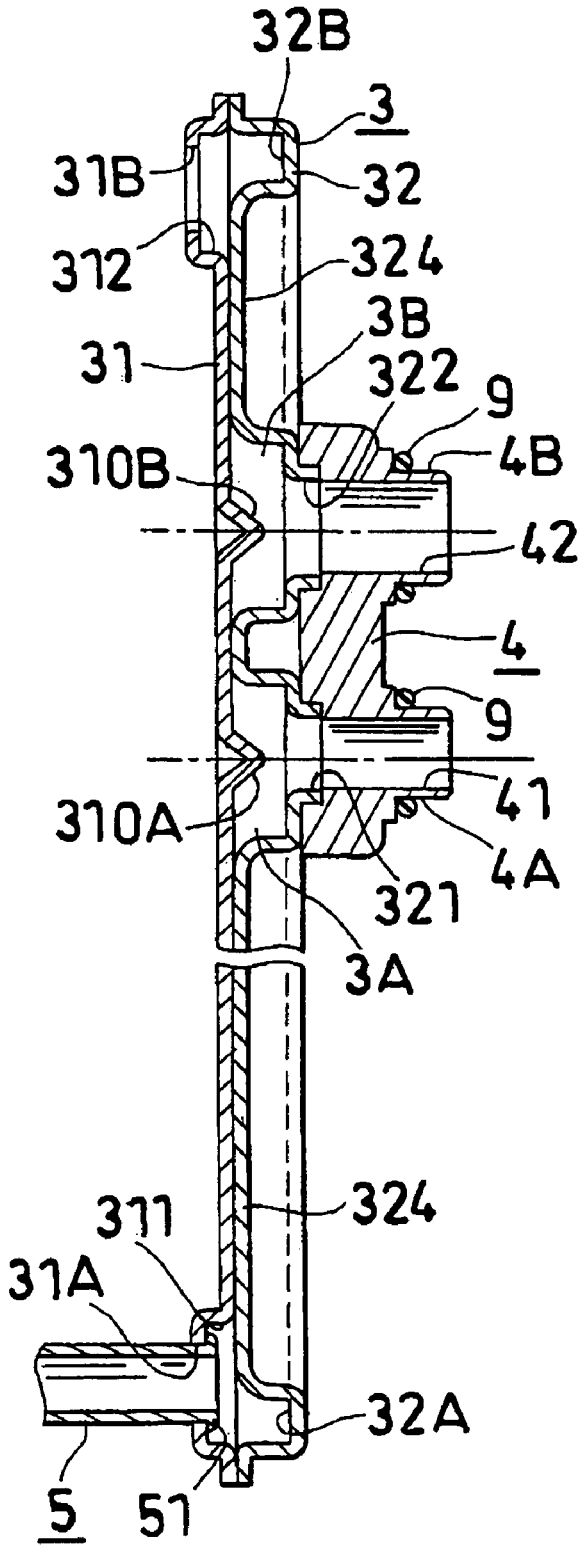
FIG. 8 is a cross-sectional view of a connecting member having a refrigerant flow smoothing projection which is substantially conical.
Figure 9:
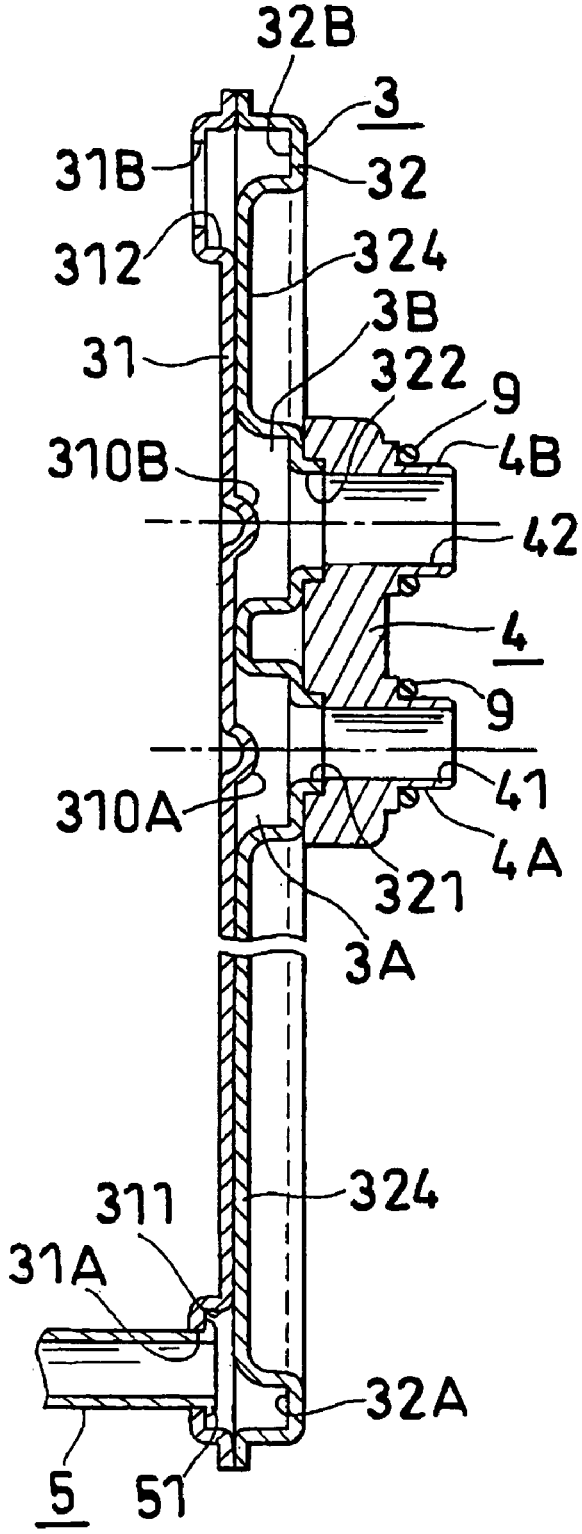
FIG. 9 is a cross-sectional view of a connecting member having a refrigerant flow smoothing projection which is substantially semispherical.

As shown in FIG. 4, the refrigerant flow smoothing projections 310A, 310B are each substantially frustoconical cone. Alternatively, these projections may be substantially conical or semispherical as illustrated in FIGS. 8 and 9.

The refrigerant inlet channel 3A inside the connecting member 3 is divided into two parallel inlet branch channels 30A in the vicinity of the inlet pipe connecting opening 321, and the branch channels 30A are combined together in the vicinity of the inlet communication hole 31A. Further the refrigerant outlet channel 3B is also divided into two parallel outlet branch channels 30B in the vicinity of the outlet communication hole 31B, and the branch channels 30B are combined together in the vicinity of the outlet pipe connecting opening 322. When the refrigerant inlet channel 3A and the outlet channel 3B are each divided into two branch channels 30A or 30B as described above, the recessed portions 32A, 32B provided in the second plate 32 for forming these channels can be smaller in width, while the flat portion 324 of the second plate 32 to be joined to the first plate 31 is given an increased area. This affords a sufficient pressure resistant strength against the flow of refrigerant even if a material of reduced thickness is used for the second plate 32.

The pipe joint member 4 is in the form of a block having upper and lower two bores 41, 42 extending laterally through the thickness thereof. The joint member 4 is joined to the outer surface of the second plate 32, with the inner end of the lower bore 41 in coincidence with the inlet pipe connecting opening 321, and with the inner end of the upper bore 42 coinciding with the outlet pipe connecting opening 322. The outer end of the lower bore 41 is provided with an outwardly projecting socket 4A for inserting the refrigerant inlet pipe thereinto for connection. The outer end of the upper bore 42 is provided with an outwardly projecting socket 4B for inserting the refrigerant outlet pipe thereinto for connection. An O-ring 9 is fitted around the base end of each of the sockets 4A, 4B.

The multi-pass providing inner pipe 5 is provided at the base end thereof with an annular flange 51 integrally therewith. The flange 51 of the inner pipe 5 is joined to an inner peripheral edge of the first plate 31 defining the inlet communication hole 31A. The flange 51 is joined to the hole-defining peripheral edge usually by tacking these joint portions by crimping and subsequent brazing.

With reference to FIG. 4, a part of the flange 51 of the inner pipe 5 is opposed to the flat portion 324 of the second plate 32, more specifically, to the lower end of the striplike flat portion 324 which is formed at the widthwise midportion of the inlet channel recessed portion 32A for dividing the refrigerant inlet channel 3A into the two branch channels, and the remaining part of the flange 51 is opposed to the lower end of the inlet channel recessed portion 32A of the second plate 32. Although the flange 51 is firmly joined to the inner peripheral edge of the first plate 31 defining the inlet communication hole 31A by brazing as described above, the flange 51 of the inner pipe 5 could inevitably slip off the hole-defining edge. In the event of such a situation occurring, the inner pipe 5 slipping off from the first plate 31 shifts rightward, with the result that the flange 51 thereof in its entirety comes into contact with the bottom wall of lower end of the inlet channel recessed portion 32A of the second plate 32. This impedes the flow of refrigerant into the inner pipe 5 or permits the refrigerant to flow into the pipe intermittently, impairing the function of the evaporator 1 and consequently rendering the motor vehicle air conditioner itself no longer serviceable as such. On the other hand, the flange 51 is partly opposed to the flat portion 324 of the second plate 32 as shown in FIG. 4. If the inner pipe 5 then inevitably slips off the first plate 31 and shifts rightward, the flange 51 will partly come into contact with the flat portion 324 of the second plate 32. However, a clearance sufficient for the refrigerant to flow into the inner pipe 5 therethrough will be created between the remaining part of the flange 51 and the bottom wall of lower end of the inlet channel recessed portion 32A of the second plate 32. Accordingly, the function of the evaporator 1 will not be substantially impaired even in the event of the above situation occurring, and the motor vehicle air conditioner can be used continuously.

Figure 6:
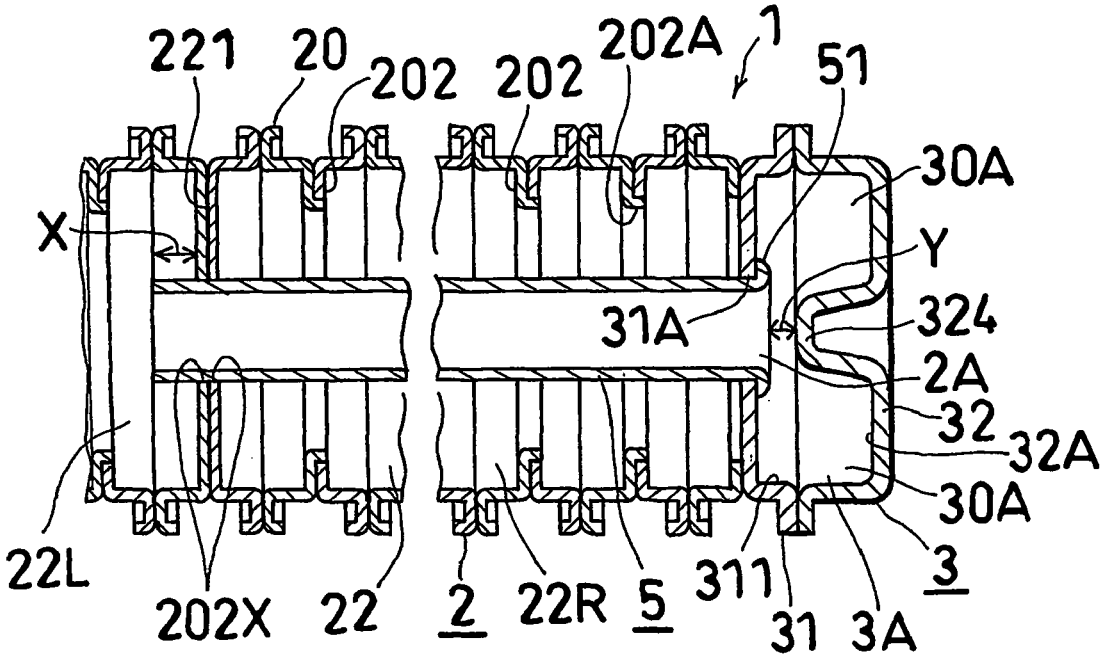
FIG. 6 shows a part of the evaporator core including a lower header, (a) being a view in horizontal section, (b) being a view in vertical section.
Figure 6:
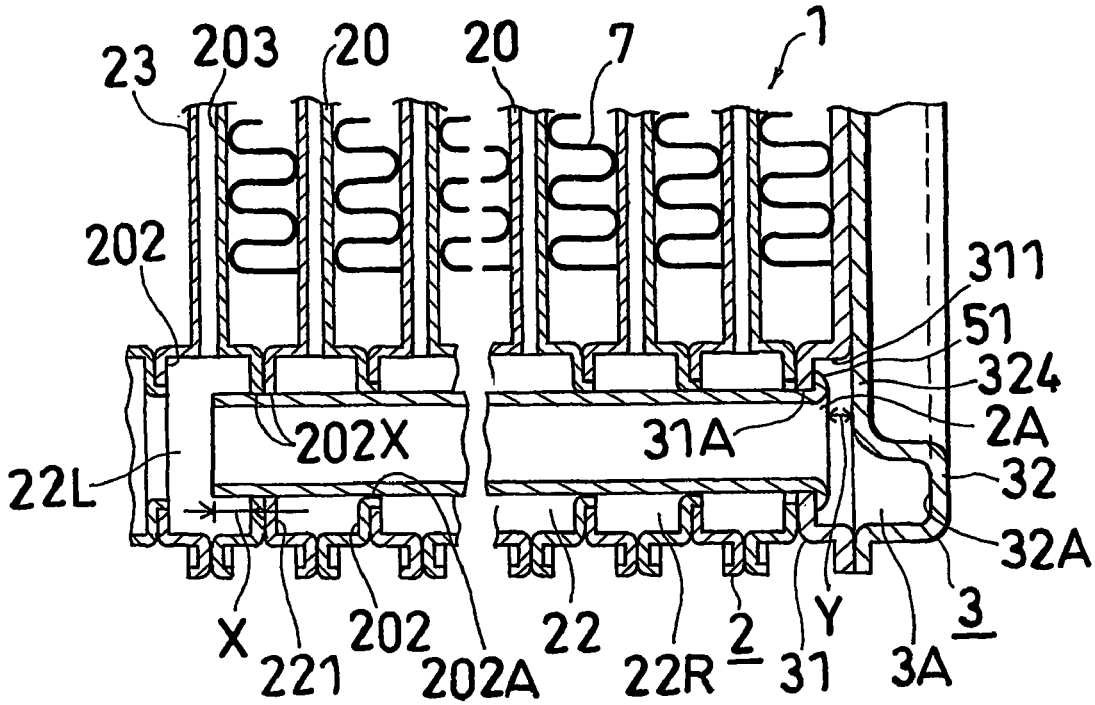

FIG. 6 shows a part of the evaporator core 2 including the lower header 22. The inner pipe 5 is inserted in the lower header 22 of the evaporator core 2 through the inlet communication hole 31A and the refrigerant inlet 2A. The forward end (left end) of the inner pipe 5 is positioned at a distance of about ⅔ of the length of the lower header 22 from the right end of the lower header 22 as seen in FIG. 2.

With reference to FIG. 6, the bottom walls of the lower header recessed portions 202 of core plates 20 are each provided with a hole 202A. The hole 202A has a shape elongated forward or rearward and substantially similar to that of the bottom wall of the recessed portion 202. Accordingly, clearances permitting the passage of the refrigerant therethrough are formed around the inner pipe 5 in the hole 202A [see FIG. 6(*a*)]. However, the hole 202X formed in the bottom wall of recessed portion 202 of each of the two core plates 20 positioned close to the forward end of the inner pipe 5 is small and circular and has a diameter approximately equal to the outside diameter of the inner pipe 5, so that no clearance is formed around the pipe 5 in the hole 202X. In other words, the bottom walls of the lower header recessed portions 202 having the hole 202X provide a partition wall 221 for dividing the interior of the lower header 22 into left and right sections (see FIGS. 6 and 7).

Although not shown, the bottom walls of the upper header recessed portions 201 of core plates 20 are also each provided with the same hole as the hole 202A in the lower header recessed portion 202. However, the hole is not formed in the bottom wall of upper header recessed portion 201 of the core plate 20 which is positioned at a distance of about ⅓ of the entire length of the evaporator core 2 from the right end of the core 2. This bottom wall provides a partition wall 211 dividing the upper header 21 into left and right sections (see FIG. 7). The two partition walls 211, 221 and the inner pipe 5 thus provided within the evaporator core 2 form a plurality of passes in the core 2. Stated more specifically, a first pass P1 is provided by the heat exchange tubes 23 positioned in a left portion of the evaporator core 2 and having lower ends communicating with the left section 22L of the lower header 22 and upper ends communicating with the left section 21L of the upper header 21. A second pass P2 is provided by the heat exchange tubes 23 positioned in a central portion of the evaporator core 2 and having upper ends communicating with the left section 21L of the upper header 21 and lower ends communicating with the right section 22R of the lower header 22. A third pass P3 is provided by the heat exchange tubes 23 positioned in a right portion of the evaporator core 2 and having lower ends communicating with the right section 22R of the lower header 22 and upper ends communicating with the right section 21R of the upper header 21.

With reference to FIG. 6, the distance X between the left end of the inner pipe 5 and the partition wall 221 is greater than the distance Y between the flange 51 at the base end of the inner pipe 51 and the flat portion 324 of the second plate 32. When the inner pipe 5 slips off the first plate 31 and shifts rightward as stated above, the left end of the pipe 5 of course also shifts rightward. If the distance X between the left end of the inner pipe 5 and the partition wall 221 is then smaller than the distance Y between the flange 51 and the flat portion 324, the refrigerant flowing inside the pipe 5 toward the left end thereof will be admitted into the section 22R of the lower header 22 on the right side of the partition wall 221 thereof instead of flowing along the contemplated refrigerant circuit in the evaporator core 2. This entails the likelihood that a sufficient air cooling effect will not be available. On the other hand, if the distance X between the left end of the inner pipe 5 and the partition wall 221 is greater than the distance Y between the flange 51 and the flat portion 324 as shown in FIG. 6, the refrigerant flowing through the inner pipe 5 is admitted into the section 22L of the lower header 22 on the left side of the partition wall 221 even if the pipe 5 shifts rightward upon slipping off. The refrigerant therefore flows normally through the evaporator core 3 to produce the desired cooling effect.

Figure 7:
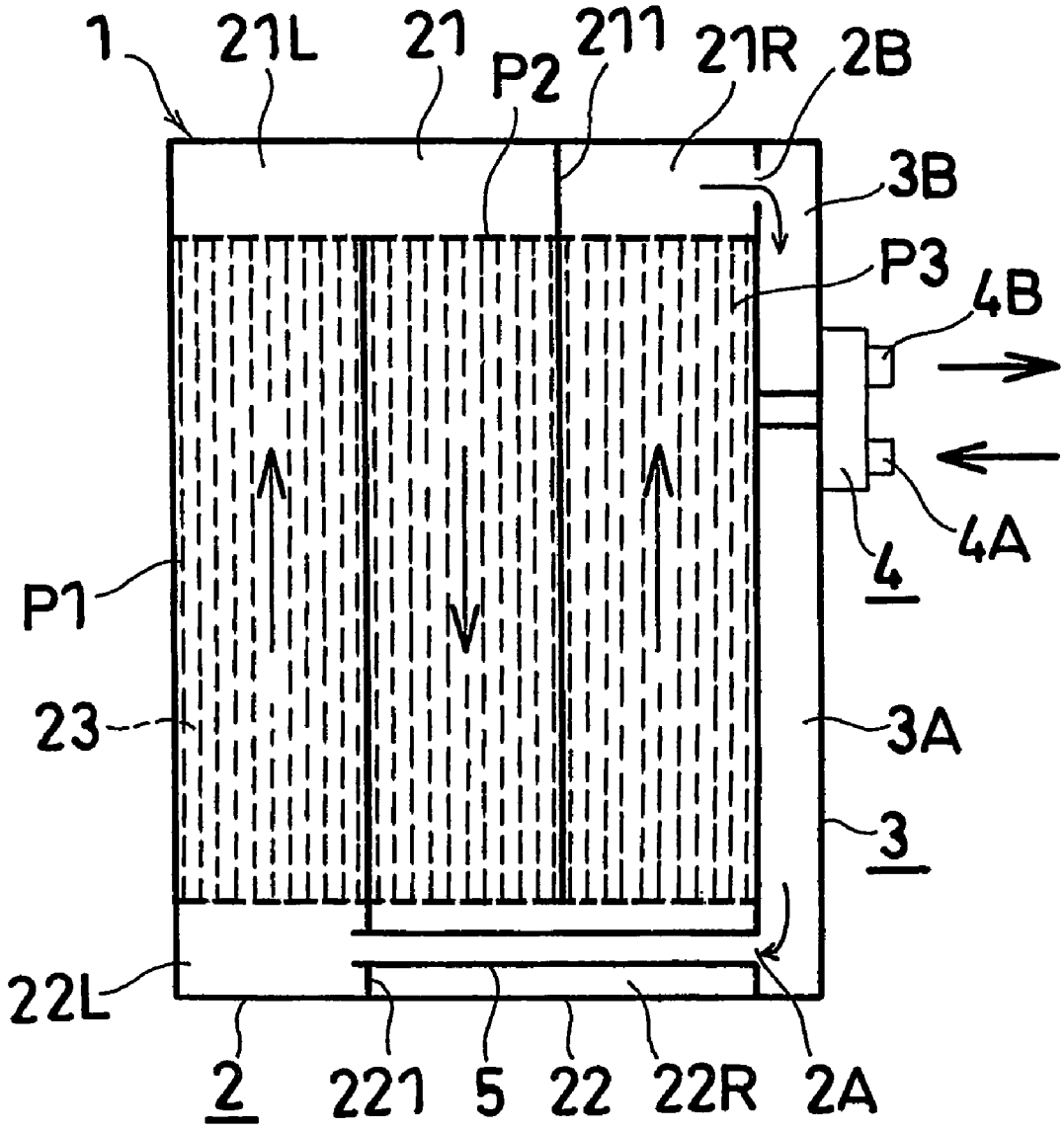
FIG. 7 is a diagram showing the flow of refrigerant within the evaporator.

FIG. 7 shows the flow of refrigerant inside the evaporator 1. Although not shown, the motor vehicle air conditioner comprises a refrigeration cycle including a compressor, condenser and expansion valve, in addition to the evaporator 1 described.

The refrigerant, as subjected to a pressure reduction by an expansion valve and in a gas-liquid two-phase state, first flows into the inlet pipe connecting opening 321 by way of the refrigerant inlet pipe and the lower bore 41 of the pipe joint member 4 and then into the refrigerant inlet channel 3A of the connecting member 3.

The refrigerant flowing in impinges on the outer surface of the first plate 31 opposed to the inlet pipe connecting opening 321, has its course thereby changed approximately through a right angle to flow through the inlet channel 3A and thereafter flows into the evaporator core 2 from the refrigerant inlet 2A. At this time, the refrigerant flowing into the inlet channel 3A flows along the surface of the lower refrigerant flow smoothing projection 310A formed on the outer surface of the first plate 31 and opposed to the inlet pipe connecting opening 321. This smoothly changes the direction of the flow, further reducing the likelihood of the flow becoming turbulent. Consequently, the projection 310A eliminates the noise to be produced by the inflow of the refrigerant.

Subsequently, the refrigerant dividedly flows down the two inlet branch channels 30A, the divided refrigerant portions combine together again in the vicinity of the inlet communication hole 31A, and the confluent refrigerant thereafter flows into the inner pipe 5 through the base end thereof. The refrigerant inlet channel 3A mentioned above is divided, in the vicinity of the inlet pipe connecting opening 321, into the two branch channels 30A, which are combined in the vicinity of the inlet communication hole 31A, so that the pressure loss of the refrigerant flowing into the inner pipe 5 is smaller than when the refrigerant inlet channel is not branched. The refrigerant therefore smoothly flows into the inner pipe 5. Accordingly, the refrigerant flows into the evaporator core 2 efficiently to achieve an improved heat exchange efficiency.

The refrigerant flowing through the inner pipe 5 flows into the left section 22L of the lower header 22 in the evaporator core 2. From this section, the refrigerant flows up the heat exchange tubes 23 constituting the first pass P1 and reaches the left section 21L of the upper header 21. The refrigerant then flows down the heat exchange tubes 23 constituting the second pass P2 to reach the right section 22R of the lower header 22. The refrigerant further flows up the heat exchange tubes 23 providing the third pass P3 and reaches the right section 21R of the upper header 21.

The refrigerant flows through the right section 21R of the upper header 21 and flows into the refrigerant outlet channel 3B of the connecting member 3 via the refrigerant outlet 2B. The refrigerant flowing in then dividedly flows down the two outlet branch channels 30B, the divided refrigerant portions combine together again in the vicinity of the outlet pipe connecting opening 322, and the confluent refrigerant thereafter flows through the opening 322 and through the upper bore 42 of the pipe joint member 4 into the refrigerant outlet pipe. The refrigerant flowing out of the outlet channel 3B at this time flows along the surface of the upper refrigerant flow smoothing projection 310B formed on the outer surface of the first plate 31 and opposed to the outlet pipe connecting opening 322. This smoothly changes the direction of the flow, further reducing the likelihood of the flow becoming turbulent. Consequently, the projection 310B eliminates the noise to be produced by the outflow of the refrigerant.

The foregoing embodiment is given for illustrative purpose only, and the present invention can of course be practiced by modifying the embodiment suitably within the scope of the invention as set forth in the appended claims.

The invention claimed is:

1. An evaporator comprising:

an evaporator core having a refrigerant inlet and a refrigerant outlet in one side portion thereof; and a connecting member joined to said one side portion of the evaporator core and having in an interior thereof a refrigerant inlet channel for holding the refrigerant inlet in communication with a refrigerant inlet pipe and a refrigerant outlet channel for holding the refrigerant outlet in communication with a refrigerant outlet pipe, the connecting member comprising a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed at one end thereof to the inlet communication hole and the outlet communication hole, respectively, the inlet channel recessed portion having on the other end thereof a bottom wall provided with an inlet pipe connecting opening, the outlet channel recessed portion having on the other end thereof a bottom wall provided with an outlet pipe connecting opening, the refrigerant inlet pipe and the refrigerant outlet pipe being connectable to the respective connecting openings by a pipe joint member joined to an outer surface of the second plate, the first plate having on the outer surface thereof a refrigerant flow smoothing projection projecting toward the inlet pipe connecting opening of the second plate, wherein the refrigerant flow smoothing projection has a center coinciding with a center of the inlet pipe connecting opening and has one of a substantially conical shape, a substantially semispherical shape and a substantially frustoconical shape.

2. An evaporator according to claim 1, wherein the evaporator has a multi-pass providing inner pipe inserted therein through the inlet communication hole and the refrigerant inlet and provided at a base end thereof with a flange joined to an inner periphery of the first plate defining the inlet communication hole, the refrigerant inlet channel is divided into at least two parallel inlet branch channels in the vicinity of the inlet pipe connecting opening, and the inlet branch channels are combined together in the vicinity of the inlet communication hole.

3. An evaporator according to claim 2 wherein the refrigerant outlet channel is divided into at least two parallel outlet branch channels in the vicinity of the outlet communication hole, the outlet branch channels being combined together in the vicinity of the outlet pipe connecting opening.

4. An evaporator according to claim 2 wherein the first plate has on the outer surface thereof an inlet recessed portion and an outlet recessed portion at portions thereof corresponding to the refrigerant inlet and the refrigerant outlet, respectively, and the inlet communication hole is formed in a bottom wall of the inlet recessed portion, the flange of the inner pipe having a part opposed to a flat portion of the second plate, and the remaining part opposed to a bottom wall of one end of the inlet channel recessed portion of the second plate.

5. An evaporator according to claim 4 wherein the flat portion of the second plate opposed to said part of the flange of the inner pipe is one end portion of a striplike flat part provided at a position intermediate the width of the inlet channel recessed portion for dividing the refrigerant inlet channel into at least two branch channels.

6. An evaporator according to claim 1, wherein the evaporator core has a multi-pass providing inner pipe inserted therein through the outlet communication hole and the refrigerant outlet and provided at a base end thereof with a flange joined to an inner periphery of the first plate defining the outlet communication hole, the refrigerant outlet channel is divided into at least two parallel outlet branch channels in the vicinity of the outlet communication hole, and the outlet branch channels are combined together in the vicinity of the outlet pipe connecting opening.

7. An evaporator according to claim 6 wherein the refrigerant inlet channel is divided into at least two parallel inlet branch channels in the vicinity of the inlet pipe connecting opening, the inlet branch channels being combined together in the vicinity of the inlet communication hole.

8. An evaporator according to claim 6 wherein the first plate has on the outer surface thereof an inlet recessed portion and an outlet recessed portion at portions thereof corresponding to the refrigerant inlet and the refrigerant outlet respectively, and the outlet communication hole is formed in a bottom wall of the outlet recessed portion, the flange of the inner pipe having a part opposed to a flat portion of the second plate, and the remaining part opposed to a bottom wall of one end of the outlet channel recessed portion of the second plate.

9. An evaporator according to claim 8 wherein the flat portion of the second plate opposed to said part of the flange of the inner pipe is one end portion of a striplike flat part provided at a position intermediate the width of the outlet channel recessed portion for dividing the refrigerant outlet channel into at least two branch channels.

10. An evaporator according to claim 1, wherein the evaporator core comprises an upper horizontal header and a lower horizontal header, and a plurality of vertical heat exchange tubes positioned laterally at a spacing and each having opposite ends communicating with the upper and lower headers, respectively, the refrigerant inlet being provided at one end of one of the upper and lower headers, the refrigerant outlet being provided at one end of the other header.

11. An evaporator according to claim 10 wherein the evaporator core comprises a multiplicity of core plates each having an upper and a lower header recessed portion, and a tube recessed portion having opposite ends integral with the respective header recessed portions and shallower than the header recessed portions, and is fabricated by joining each pair of these core plates to each other with each pair of corresponding recessed portions opposed to each other.

12. A refrigeration cycle comprising an evaporator according to claim 1.

13. An evaporator comprising:

an evaporator core having a refrigerant inlet and a refrigerant outlet in one side portion thereof; and a connecting member joined to said one side portion of the evaporator core and having in an interior thereof a refrigerant inlet channel for holding the refrigerant inlet in communication with a refrigerant inlet pipe and a refrigerant outlet channel for holding the refrigerant outlet in communication with a refrigerant outlet pipe, the connecting member comprising a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed at one end thereof to the inlet communication hole and the outlet communication hole, respectively, the inlet channel recessed portion having on the other end thereof a bottom wall provided with an inlet pipe connecting opening, the outlet channel recessed portion having on the other end thereof a bottom wall provided with an outlet pipe connecting opening, the refrigerant inlet pipe and the refrigerant outlet pipe being connectable to the respective connecting openings by a pipe joint member joined to an outer surface of the second plate, the first plate having on the outer surface thereof a refrigerant flow smoothing projection projecting toward the outlet pipe connecting opening of the second plate, wherein the refrigerant flow smoothing projection has a center coinciding with a center of the outlet pipe connecting opening and has one of a substantially conical shape, a substantially semispherical shape and a substantially frustoconical shape.

14. An evaporator according to claim 13, wherein the evaporator has a multi-pass providing inner pipe inserted therein through the inlet communication hole and the refrigerant inlet and provided at a base end thereof with a flange joined to an inner periphery of the first plate defining the inlet communication hole, the refrigerant inlet channel is divided into at least two parallel inlet branch channels in the vicinity of the inlet pipe connecting opening, and the inlet branch channels are combined together in the vicinity of the inlet communication hole.

15. An evaporator according to claim 13, wherein the evaporator core has a multi-pass providing inner pipe inserted therein through the outlet communication hole and the refrigerant outlet and provided at a base end thereof with a flange joined to an inner periphery of the first plate defining the outlet communication hole, the refrigerant outlet channel is divided into at least two parallel outlet branch channels in the vicinity of the outlet communication hole, and the outlet branch channels are combined together in the vicinity of the outlet pipe connecting opening.

16. An evaporator according to claim 13, wherein the evaporator core comprises an upper horizontal header and a lower horizontal header, and a plurality of vertical heat exchange tubes positioned laterally at a spacing and each having opposite ends communicating with the upper and lower headers, respectively, the refrigerant inlet being provided at one end of one of the upper and lower headers, the refrigerant outlet being provided at one end of the other header.

17. A refrigeration cycle comprising an evaporator according to claim 13.

18. An evaporator comprising:

an evaporator core having a refrigerant inlet and a refrigerant outlet in one side portion thereof; and a connecting member joined to said one side portion of the evaporator core and having in an interior thereof a refrigerant inlet channel for holding the refrigerant inlet in communication with a refrigerant inlet pipe and a refrigerant outlet channel for holding the refrigerant outlet in communication with a refrigerant outlet pipe, the connecting member comprising a first plate having an inlet communication hole and an outlet communication hole and joined to said one side portion of the evaporator core so that the communication holes communicate with the respective refrigerant inlet and outlet, and a second plate having an inlet channel recessed portion and an outlet channel recessed portion and joined to an outer surface of the first plate so that the recessed portions are opposed at one end thereof to the inlet communication hole and the outlet communication hole, respectively, the inlet channel recessed portion having on the other end thereof a bottom wall provided with an inlet pipe connecting opening, the outlet channel recessed portion having on the other end thereof a bottom wall provided with an outlet pipe connecting opening, the refrigerant inlet pipe and the refrigerant outlet pipe being connectable to the respective connecting openings by a pipe joint member joined to an outer surface of the second plate, the first plate having on the outer surface thereof two refrigerant flow smoothing projections projecting respectively toward the inlet pipe connecting opening and the outlet pipe connecting opening of the second plate, wherein centers of the two refrigerant flow smoothing projections are in coincidence with respective centers of the inlet pipe connecting opening and the outlet pipe connecting opening and the refrigerant flow smoothing projections have one of a substantially conical shape, a substantially semispherical shape and a substantially frustoconical shape.

19. An evaporator according to claim 18, wherein the evaporator has a multi-pass providing inner pipe inserted therein through the inlet communication hole and the refrigerant inlet and provided at a base end thereof with a flange joined to an inner periphery of the first plate defining the inlet communication hole, the refrigerant inlet channel is divided into at least two parallel inlet branch channels in the vicinity of the inlet pipe connecting opening, and the inlet branch channels are combined together in the vicinity of the inlet communication hole.

20. An evaporator according to claim 18, wherein the evaporator core has a multi-pass providing inner pipe inserted therein through the outlet communication hole and the refrigerant outlet and provided at a base end thereof with a flange joined to an inner periphery of the first plate defining the outlet communication hole, the refrigerant outlet channel is divided into at least two parallel outlet branch channels in the vicinity of the outlet communication hole, and the outlet branch channels are combined together in the vicinity of the outlet pipe connecting opening.

21. An evaporator according to claim 18, wherein the evaporator core comprises an upper horizontal header and a lower horizontal header, and a plurality of vertical heat exchange tubes positioned laterally at a spacing and each having opposite ends communicating with the upper and lower headers, respectively, the refrigerant inlet being provided at one end of one of the upper and lower headers, the refrigerant outlet being provided at one end of the other header.

22. A refrigeration cycle comprising an evaporator according to claim 18.

* * * * *